US007416358B2

(12) United States Patent
Legendre

(10) Patent No.: US 7,416,358 B2
(45) Date of Patent: Aug. 26, 2008

(54) APPLICATOR INTENDED TO BE ATTACHED TO A FINGER

(75) Inventor: Jean-Yves Legendre, Paris (FR)

(73) Assignee: L'Oreal, Paris (FR)

( * ) Notice: Subject to any disclaimer, the term of this patent is extended or adjusted under 35 U.S.C. 154(b) by 244 days.

(21) Appl. No.: 10/824,478

(22) Filed: Apr. 15, 2004

(65) Prior Publication Data

US 2004/0258457 A1 Dec. 23, 2004

Related U.S. Application Data

(60) Provisional application No. 60/474,675, filed on Jun. 2, 2003.

(30) Foreign Application Priority Data

Apr. 15, 2003 (FR) ..... 03 04711

(51) Int. Cl.
*A46B 5/04* (2006.01)
*B43K 15/14* (2006.01)
*B43K 5/00* (2006.01)

(52) U.S. Cl. ..... 401/205; 401/7; 401/8; 401/133; 401/134

(58) Field of Classification Search ..... 401/7, 401/8, 132–134, 205
See application file for complete search history.

(56) References Cited

U.S. PATENT DOCUMENTS 1,947,720 A * 2/1934 Laub ..... 401/7
2,016,951 A * 10/1935 Logue ..... 401/7
2,763,885 A 9/1956 Lyons
3,070,102 A * 12/1962 MacDonald ..... 15/104.94
3,368,668 A * 2/1968 Micciche ..... 206/229
4,053,242 A 10/1977 Mast, Jr.
4,083,078 A * 4/1978 Shimizu ..... 15/244.1
4,145,147 A * 3/1979 Schuck ..... 401/175
4,148,318 A 4/1979 Meyer
4,665,901 A * 5/1987 Spector ..... 601/139
4,893,956 A 1/1990 Wojcik et al.
5,045,073 A 9/1991 Wagner
5,615,440 A 4/1997 Cowan et al.
5,678,273 A 10/1997 Porcelli
5,997,885 A 12/1999 Koulbanis et al.
6,009,887 A 1/2000 Hertel
6,371,132 B1 4/2002 Lacout
6,435,195 B1 8/2002 Joulia
2001/0036384 A1 11/2001 Redmond

FOREIGN PATENT DOCUMENTS

JP 56-36935 4/1981

(Continued)

*Primary Examiner*—David J Walczak
(74) *Attorney, Agent, or Firm*—Oblon, Spivak, McClelland, Maier & Neustadt, P.C.

(57) ABSTRACT

An applicator for the application of a product, for example a cosmetic or dermatological product, including a reservoir of which a first side is attached to a finger or mounted to a finger to face the finger. An applicator portion is arranged on a second side of the reservoir opposite the first, and the applicator portion is isolated from the reservoir at least before first use of the applicator. The applicator device further includes a device to establish communication between the reservoir and the applicator portion, for example, in response to an operating action at least during the first use of the applicator.

67 Claims, 3 Drawing Sheets

FOREIGN PATENT DOCUMENTS

| | | |
|---|---|---|
| JP | 57-128909 | 8/1982 |
| JP | 02-180278 | 7/1990 |
| JP | 03-196868 | 8/1991 |
| JP | 2000-354514 | 12/2000 |
| JP | 2003-096608 | 4/2003 |
| WO | WO 02/13655 | 2/2002 |

* cited by examiner

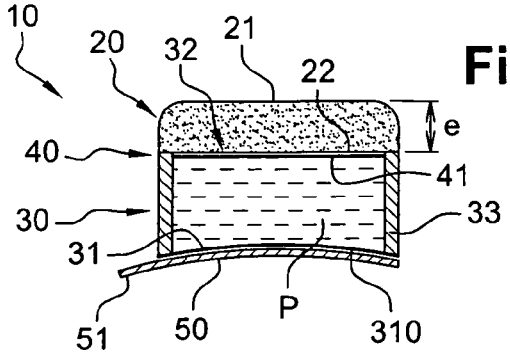
Fig. 1
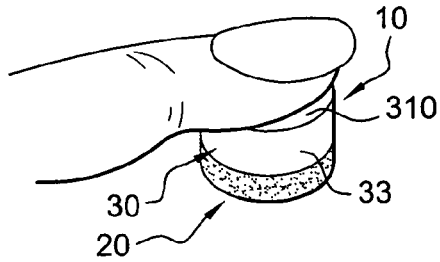
Fig. 2
Fig. 3
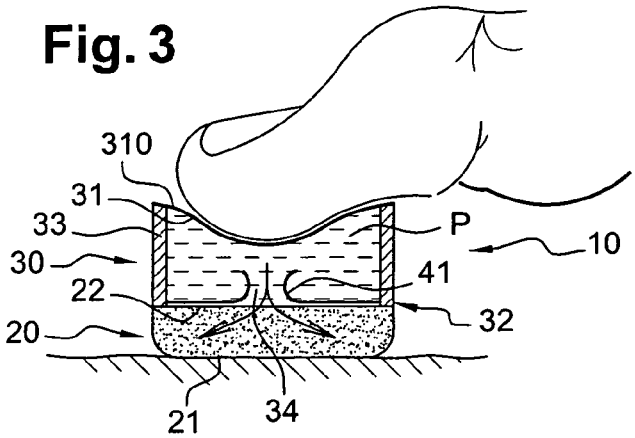
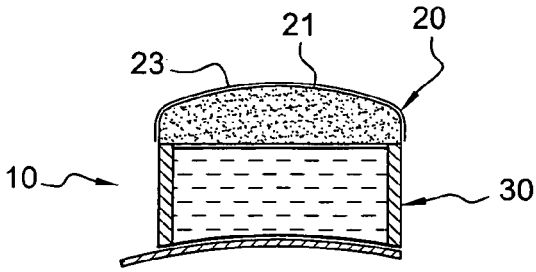
Fig. 4
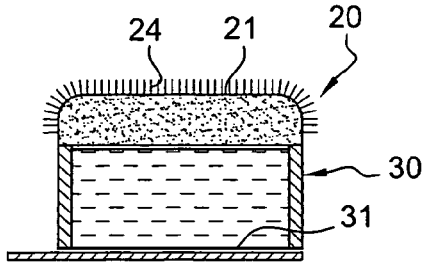
Fig. 5

Fig. 6A
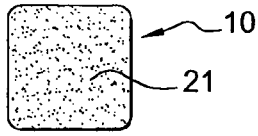
Fig. 6B
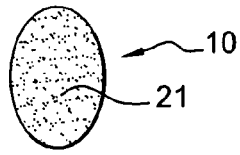
Fig. 6C
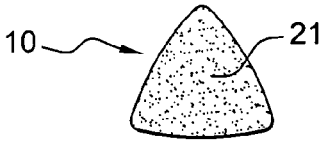
Fig. 6D
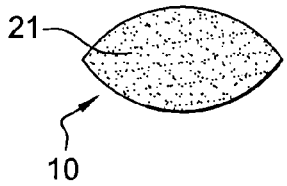
Fig. 6E
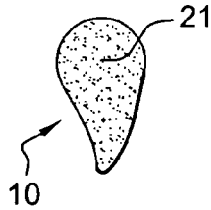
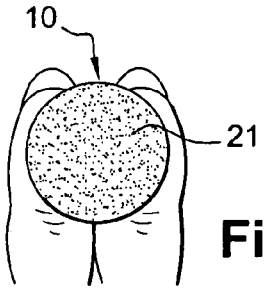
Fig. 7
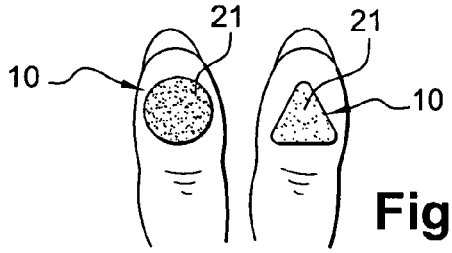
Fig. 8
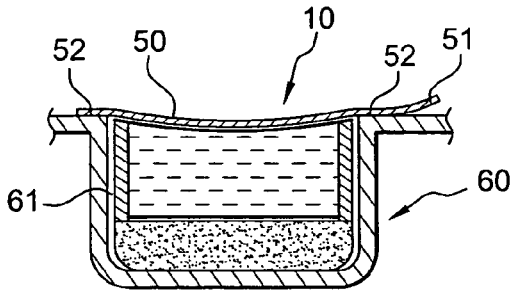
Fig. 9
Fig. 10
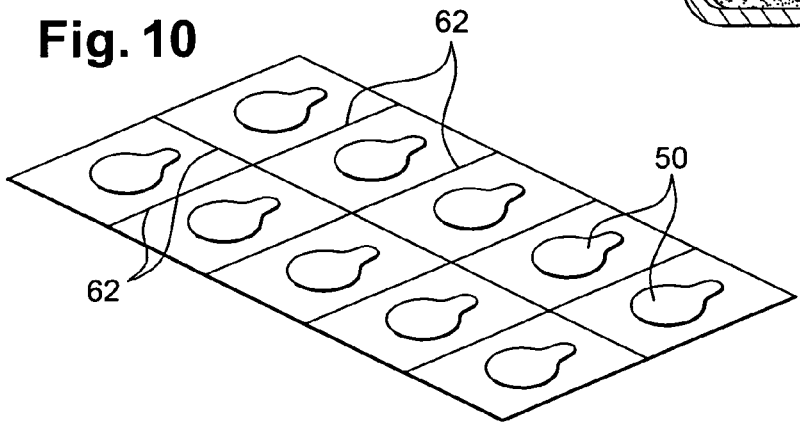

APPLICATOR INTENDED TO BE ATTACHED TO A FINGER

CROSS REFERENCE TO RELATED APPLICATION

This document claims priority to French Application Number 03 04711, filed Apr. 15, 2003 and U.S. Provisional Application No. 60/474,675, filed Jun. 2, 2003, the entire contents of which are hereby incorporated by reference.

FIELD OF THE INVENTION

The present invention relates to applicators for the application of a product. The invention can be particularly advantageous as an applicator for a cosmetic or dermatological product.

BACKGROUND OF THE INVENTION

Discussion of Background

The application of a cosmetic or dermatological formulation for topical use is sometimes accomplished directly with the finger. However, in applying the product in this manner, one is confronted with the problem of hygiene and contamination of the product.

For this reason, a variety of cosmetic or medical applicators have been proposed. These generally include an applicator element on which is fixed a solid support allowing the applicator to be grasped. For example, U.S. Pat. Nos. 6,371,132, 6,435,195, 4,053,242, 5,615,440 and 6,009,887 describe such applicators. In some instances, the applicator element may be pre-impregnated with the product to be applied, as is the case with the applicator described in U.S. Pat. No. 4,893,956. U.S. application ser. No. 2001/036384 describes a system enabling a sponge type support to be impregnated extemporaneously with a liquid. The system includes a reservoir for the liquid at one end of which the sponge is attached. When pressure is applied to the reservoir, the inside of the reservoir is placed in communication with the sponge. To apply the product, the device must be grasped with one hand.

However, these devices can be cumbersome and do not allow a very precise quantity of product to be applied to a precisely delineated application zone. In addition, these devices limit the effectiveness of a massaging effect such as can be obtained with the finger.

A system that can be attached to the end of the finger has been proposed for use in dental hygiene. U.S. Pat. No. 2,763,885 describes such a system composed of an abrasive foam impregnated with toothpaste. U.S. Pat. No. 5,678,273 describes a similar system. However, the supports described are not suited to the application of a cosmetic or medical preparation.

Moreover, such systems pre-impregnated with product do not ensure the requisite stability of certain products.

SUMMARY OF THE INVENTION

One of the objects of the invention is therefore to provide an applicator which does not present the drawbacks of the prior art.

It is a particular object of the invention to provide an applicator having compact dimensions that will allow a precise quantity of product to be applied to a precisely defined application zone.

It is a further object of the invention to provide an applicator that promotes penetration of the product by massage.

Another object of the invention is also to provide an applicator that ensures the absence of external contamination of the product.

A further object of the invention is to provide such an applicator in ready to use form.

According to the invention, these objects can be achieved by an applicator for the application of a product, such as a cosmetic or dermatological product, including a reservoir of which a first side includes means intended to attach the applicator to a finger, with an applicator portion arranged on a second side of the reservoir opposite the first. The applicator portion preferably is isolated from the reservoir at least before first use of the applicator. In addition, means are provided at least during first use of the applicator to establish communication between the reservoir and the applicator portion in response to an operating action.

The product contained in the reservoir can be isolated from the applicator portion, and the applicator can therefore avoid contamination and soiling of the product contained in the reservoir before application. In addition, the applicator can optionally be used to apply two mutually incompatible products or product components, or products/product components that are unstable over time by extemporaneously mixing the products at the time of application. As a further alternative, products which produce an exothermic reaction when placed in contact can be used with one of the products being held in the reservoir and the other in the applicator portion.

The arrangement can also be advantageously used to apply products that are highly soluble in water which cannot be picked up directly with the fingers due to their sensitivity to moisture.

Also, this applicator can be used to apply relatively precise "finger" makeup without, however, touching the product.

The means of attachment can be composed of an adhesive layer formed by the first side of the reservoir, a ring or loop encircling the finger, a finger stall, or a "velcro" (hook and loop) type system.

The means to establish communication between the reservoir and the applicator portion can include a membrane capable of breaking in response to pressure exerted from the first side of the reservoir during the first use of the applicator.

Alternatively or additionally, the means to establish communication between the reservoir and the applicator portion can include an element capable of piercing the second side of the reservoir. This element can be formed, for example, by a spike integral with the first side of the reservoir.

In another embodiment, the means to establish communication between the reservoir and the applicator portion can include at least one valve capable of opening in response to an excess pressure generated inside the reservoir. The communication between the reservoir and the applicator portion can then be reversible if desired.

The first side of the reservoir can be configured so as to deform in response to external pressure thereby establishing communication between the reservoir and the applicator portion. In particular, this first side can be pushed inward towards the inside of the reservoir when pressed with a finger. Thus, the interior volume of the reservoir can be reduced and excess pressure generated inside the reservoir causing the membrane to rupture. When the first side of reservoir is depressed, this can also, for example, cause a spike to engage with the membrane so as to pierce it.

The applicator portion can be made of a porous or fibrous material, such as a thermoplastic foam material, sponge, felt, or natural fibers such as cotton.

The applicator portion can be made of a resiliently deformable material so as to obtain a relatively flexible application.

The applicator portion can include an application surface covered with a flock material, a non-woven or a woven material.

An adhesive layer can be provided, for example, with a hypoallergenic adhesive.

By way of example, when viewed in cross-section through the thickness, the applicator can have a convex shape, at least on that side of the face used to apply the product.

Also by way of example, when viewed in cross-section through the thickness, the applicator can have a concave shape on the first side of the reservoir or a side of the device that faces the finger. This shape facilitates the placement of a finger on that side.

Alternatively, when viewed in cross-section through the thickness, the applicator can have a flattened shape with a first side of the reservoir substantially parallel to the face used to apply the product.

In frontal view, the applicator can have a circular shape or a non-circular shape, for example a generally triangular, square, oval, a drop shape or an almond shape.

The first wall of the reservoir can be coated with adhesive and can be covered with a removable protective film before the first use.

The product contained in the reservoir can be in liquid, semi-liquid or paste form.

The applicator portion can optionally contain an additional or second product (or, in other words, a second product component) intended to be mixed with the product held in the reservoir, with the second product being, for example, preferably in the form of a liquid, semi-liquid, paste or in powder form.

The reservoir can define a volume which is substantially cylindrical, spherical or any other shape. The reservoir can be made of polyethylene, polypropylene, PVC, polyamide, thermoplastic elastomers (SEBS), polycarbonates or teflon.

The objects of the invention can also be achieved by providing a packaging and applicator device incorporating a closed recess containing at least one applicator such as those just described.

The packaging or container can be in the form of a sachet or a cell closed by a film.

The applicator device according to the invention is particularly useful for the application of a cosmetic or dermatological product, such as a disinfectant product, a sunscreen, a moisturizing product, an anti-wrinkle product, a nail varnish or nail product, a foundation, a lip product such as a lip color or gloss product, a makeup remover, a hair care product, a hair coloring product, a deodorant or antiperspirant product, or a perfume.

BRIEF DESCRIPTION OF THE DRAWINGS

The invention will become further apparent from the following detailed description, particularly when considered in conjunction with the drawings in which:

FIG. 1 illustrates a sectional view of a first embodiment of an applicator according to the invention before use;

FIG. 2 illustrates a perspective view of the first embodiment of the applicator during use;

FIG. 3 illustrates a sectional view of the first embodiment of the applicator during use;

FIGS. 4, 5, 6A to 6E, 7 and 8 illustrate alternative embodiments of the applicator according to the invention;

FIG. 9 is a sectional view of an applicator contained in a packaging device;

FIG. 10 illustrates a pack containing several applicators;

DETAILED DESCRIPTION OF THE PREFERRED EMBODIMENTS

Figure 11:
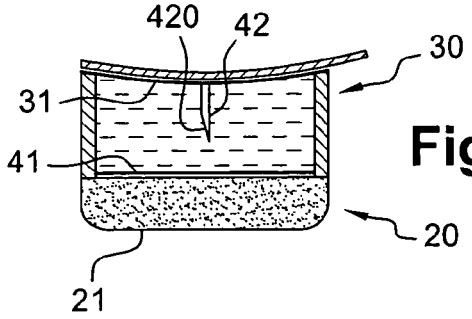
FIGS. 11 and 12 illustrate another embodiment of an applicator according to the invention.

The applicator 10 shown in FIGS. 1 to 3 includes a reservoir of product 30 and an applicator portion 20 used to apply a product to the skin, the mucous membranes, or other parts of the body such as the hair or nails.

The applicator portion 20 can include, for example, a layer of a porous or fibrous material. By way of example, the applicator portion can include an elastically deformable material such as open or closed cell foam, felt or any other cellular structure, such as a natural or artificial sponge material, or fibrous structures such as cotton or textile materials, or a combination of these.

The applicator portion can also include or be composed of a film, which can have a relatively small thickness.

In a frontal view, the applicator portion 20 can have a circular shape. In addition, the applicator can have a substantially constant thickness e, giving it a flattened shape.

On one side, the applicator portion 20 defines an application surface 21 intended to be applied to an area to be treated and, on the opposite side, a surface 22 can be glued around its periphery to a membrane 41. Alternatively, the surface 22 can be heat-sealed to the membrane 41 around its periphery.

The membrane 41 forms a wall of the reservoir 30 holding the product on one side 32 of the reservoir. The membrane is leaktight with respect to the product so as to isolate the applicator portion from product held in the reservoir. The membrane 41 can be made, for example, of polyethylene or polypropylene, PVC, polyamide, thermoplastic elastomers (SEBS), polycarbonates, or polyurethane.

The reservoir 30 includes a sidewall 33 having a circular cross-section on the free edge of which the membrane 41 is glued or heat-sealed. The sidewall is made, for example, of plastic, such as polyethylene, polypropylene, PVC, polyamide, thermoplastic elastomers (SEBS), or polycarbonates. Preferably, a sufficient thickness is chosen so that this sidewall is relatively rigid.

On the side opposite the side 32 of the reservoir, the sidewall 33 of the reservoir in the illustrated embodiment is closed by a slightly concave wall 31. The wall 31 is relatively thin, being for example between 200 μm and 2000 μm, and preferably between 500 μm and 1000 μm, so that it can deform in response to pressure exerted by a finger.

On its surface opposite the inside of the reservoir, the wall 31 is coated with a layer of adhesive 310. The adhesive can be a permanent, water-resistant, hypoallergenic adhesive which adheres more strongly to the wall 31 than to the skin. The adhesive layer 310 can be in the form of a film-which can cover the entire surface of the wall 31. The adhesive layer can also be in the form of a pattern of points, a series of bands, or may extend only in the central region of the wall 31. The adhesive layer can also be covered, for example, by a mesh to reduce its bonding capacity.

The adhesive layer 310 can be covered, before first use, with a removable protective film 50 which can incorporate a tab 51 projecting beyond the sidewall 33 of the reservoir 30 to facilitate its removal. The protective film 50 can be made, for example, of silicone-treated paper or polyethylene film.

The reservoir 30 preferably contains a liquid, semi-liquid or paste form product P, in the form of a cosmetic or dermatological preparation.

The applicator portion 20 can also be pre-impregnated with a second product or product component, also in the form of a liquid, semi-liquid, paste, or in powder form. This notably facilitates the application of two mutually incompatible preparations or components, or preparations or components that are unstable over time with the products separate from each other for storage and then mixed for application.

To use the applicator 10, the user peels off the removable protective film 50 and places a finger on the face of the wall 31 coated with adhesive. The applicator 10 is thus attached to the first pad of the index finger, for example, as can be seen in FIG. 2. The application surface 21 is then applied to the part of body to be treated with the preparation. During this application, the wall 31 deforms inward towards the reservoir thereby reducing its volume. Excess pressure is thus created inside the reservoir, with this excess pressure being such that the membrane 41 tears and forms a passage 34 illustrated in FIG. 3. The product P can then flow into the applicator portion 20 through the passage 34. The product moves, for example, by pressure, or simply by gravity or also by capillary action in the pores or between the fibers of the porous or fibrous material of which the applicator portion 20 is made, to the application surface 21. The product can also move towards the applicator portion by the pumping action of the material constituting the applicator portion when the applicator is elastically deformable. The product can then be spread over a precisely defined area and/or the area can be massaged.

The applicator 10 can, for example, be used to apply anti-wrinkle preparations based on vitamin C or retinol to crows-feet or to the area above the top lip. In a similar manner, it can be used for the application of anti-viral preparations to cold sores.

Again by way of example, the applicator can also be used to apply eyeshadow or lipstick or other lip products. It can also be used to apply perfume spots or nail polish remover, or to apply micro-peels to the face.

The applicator 10 can of course have a shape different from that just described, such as one adapted to suit the part of the body or face to which it is to be applied. The applicator 10 can, for example, have a domed application surface 21, for example, outwardly convex, as illustrated in FIG. 4. In this example, the application surface 21 is covered with a film of non-woven material 23.

In the example illustrated in FIG. 5, the application surface 21 incorporates a flock material 24. In this example, the wall 31 is flat and not concave.

When viewed from the front, the applicator 10 can have a shape other than circular, for example to enable a product to be applied more easily or more precisely to a given part of the face, for example the eyelids or lips. FIGS. 6A to 6E show frontal views of different examples of possible shapes, among others. In frontal view, the applicator 10 can have a shape that is substantially square (FIG. 6A), oval (FIG. 6B), triangular (FIG. 6C), almond shaped (FIG. 6D) or drop shaped (FIG. 6E).

In a variant not shown, the applicator portion 20 can include or can be formed by a thin film polymer. This film can, for example, contain a preparation to be applied which will be dissolved extemporaneously by an aqueous solution contained in the reservoir.

In accordance with the scope of the present invention, one applicator 10 can be placed on the ends of two fingers together, as illustrated in FIG. 7, or two applicators with different shapes, for example, can be used with each attached to the end of a finger, as illustrated in FIG. 8. Further, by way of example, two opposing applicators attached to two opposing fingers can be used to produce a pincer action to remove makeup from the eyelashes or to apply color to a lock of hair. In the case of eyelash makeup, such use of two applicators can prevent the formation of dark rings under the eyes and without soiling either the eye or the eyelid. Such use of two or more applicators can also facilitate the handling of several products at once, for example to apply a creative multi-colored makeup.

The applicator 10 can be packaged, for example, in a sachet. Alternatively, the applicator 10 can be placed in a cell 60 made, for example, by thermo-forming a plate of thermoplastic material, as illustrated in FIG. 9. The cell defines a recess 61 in which the applicator 10 is held. The removable protective film 50 is then attached to the cell around the recess, for example by means of a heat seal 52, so as to close the recess 61 in a leaktight manner. Each recess can include a single applicator, or alternatively, each recess can accommodate two or more applicators 10.

The cell can also delineate several recesses 61, each holding one or more applicators 10, as illustrated in FIG. 10. Pre-cut lines 62 can be disposed around each recess to allow the detachment of each recess holding an applicator. In addition, each cell or recess can be closed by a removable protective film 50.

Figure 12:
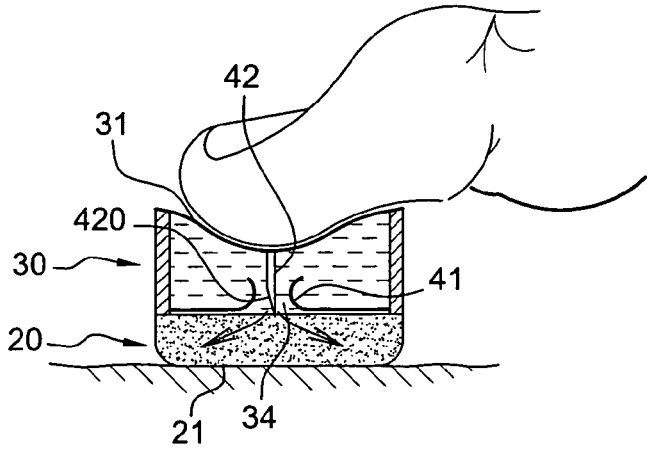

In another embodiment shown in FIGS. 11 and 12, the applicator 10 can additionally include means capable of piercing the membrane 41 that isolates the applicator portion 20 from the product contained in the reservoir 30. For example, this can take the form of a spike 42 formed from or extending from the wall 31 and of which the free cutting end 420 is oriented towards the membrane 41. As illustrated in FIG. 11, the free cutting end 420 of the spike is held at a distance from the membrane 41 when the wall 31 is not deformed. When the user attaches her finger to the wall 31 and applies the application surface 21 onto the area to be treated, the wall 31 is deformed inward towards the reservoir and moves the spike 42 to the membrane 41. The cutting end 420 of the spike then pierces the membrane 41 so as to form a passage 34 for the product, as illustrated in FIG. 12.

Figure 14:
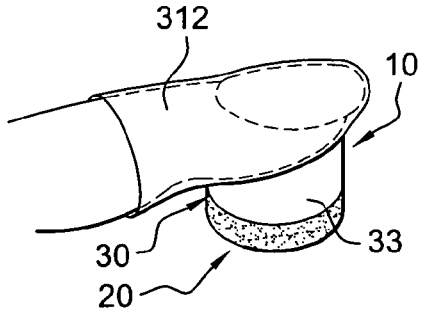
Figure 15:
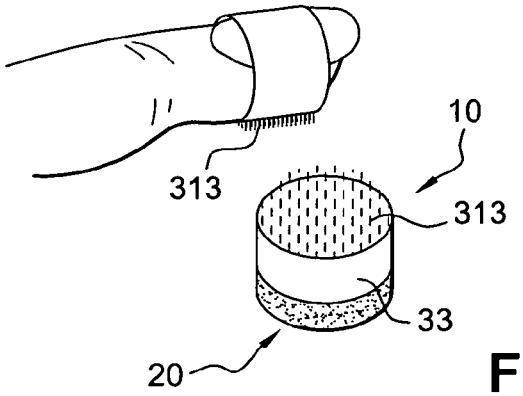

The means of attaching the applicator to one or more fingers can be different from a layer of adhesive such as that just described. By way of example, FIGS. 13 to 15 illustrate various examples of means of attaching the applicator to a finger in a reversible manner.

Figure 13:
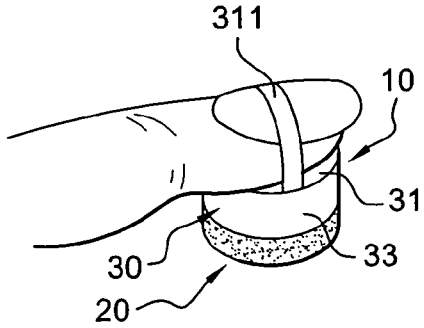
FIGS. 13, 14 and 15 illustrate other embodiments of an applicator according to the invention.

In FIG. 13, the applicator 10 is, for example, attached to the finger by a ring or loop 311 which encircles a portion of a finger. The applicator can also be attached to the finger by means of a finger stall 312 as illustrated in FIG. 14. In these two embodiments, the ring and the finger stall can be integral with the side 31 of the reservoir 30. Alternatively, a "velcro" or hook and loop type system 313 can be used, as illustrated in FIG. 15, to secure a ring or a finger stall to the side 31 of the reservoir in order to attach the applicator 10 to a finger.

Purely by way of illustration, particular examples of an applicator according to the invention will now be described in reference to particular applications.

EXAMPLE 1

The applicator 10 can be used to apply a skincare cream with a salicylic acid base. In this example, the applicator portion 20 is made of polyurethane foam. The surface 22 of the applicator portion is glued around its periphery, by means of an acrylic adhesive, to a polyethylene membrane 41. The sidewalls 33 and the wall 31 of the reservoir 30 are made of low density polyethylene. The reservoir 30 contains 0.2 ml of a skincare cream containing 1% salicylic acid. Finally, the wall 31 of the container is covered with a silicone adhesive.

EXAMPLE 2

The applicator 10 can be used to apply an exact dose of pure vitamin C. In this example, the applicator portion 20 is a sponge. The sponge is impregnated with pure vitamin C in powder form. The surface 22 of the applicator portion is glued around its periphery, by means of an acrylic adhesive, to a polyethylene membrane 41. The sidewalls 33 and the wall 31 of the reservoir 30 are made of polypropylene. The reservoir 30 in this example contains 0.2 ml of thermal water. Thermal water or water from a hot/warm natural spring is used by way of example in this embodiment. Such water is disclosed, for example, in U.S. Pat. No. 5,997,885, which is hereby incorporated by reference. See, e.g., '885 col. 3, lines 10-18. Finally, the wall 31 of the container is covered with a silicone adhesive. At the time of application, the thermal water soaks into the sponge and wets dissolves the vitamin C thereby enabling it to exert its action on the skin. Such an applicator preserves the integrity of the vitamin C, which is unstable in solution, in comparison with a dissolved form, such that the vitamin C does not deteriorate while the product is stored and remains active.

In the foregoing detailed description reference is made to preferred embodiments of the invention. It is evident that variants thereto can be proposed without departing from the invention as claimed herebelow. Accordingly, it is to be understood that numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An applicator for the application of a product, comprising:

a reservoir including a first side and a second side, wherein the second side is on an opposite side of the reservoir than the first side, and wherein the first side faces toward a finger when the applicator is mounted on a finger;

means to attach the applicator to a finger;

an applicator portion having a first surface configured to engage a portion of a body during use and a second surface secured to the second side of the reservoir located immediately adjacent the second surface of the applicator portion, the applicator portion being isolated from the reservoir at least before first use of the applicator; and a membrane breakable in response to an operating action at least during first use of the applicator, wherein the applicator portion is permeable to the product, wherein the second surface of the applicator portion and the second side of the reservoir have respective areas and said second surface of the applicator portion and said second side of the reservoir are in contact with each other along substantially all their respective areas, and wherein the membrane forms the second side of the reservoir.

2. An applicator according to claim 1, wherein the means to attach the applicator includes at least one of an adhesive layer formed by the first side of the reservoir, a ring, a finger stall, or a hook and loop system.

3. An applicator according to claim 2, wherein the operating action includes pressure exerted from the first side of the reservoir during first use of the applicator.

4. An applicator according to claim 3, wherein the membrane forms the entire second side of the reservoir and wherein second surface of the applicator portion and membrane have a substantially same area.

5. An applicator according to claim 3, wherein the applicator portion covers an opening in the membrane created by the breaking of the membrane.

6. An applicator according to claim 3, wherein after breaking, the product flows through the broken membrane so that it passes through the applicator portion to an application surface of the applicator.

7. An applicator according to claim 1, wherein the operating action includes pressure exerted from the first side of the reservoir during first use of the applicator.

8. An applicator according to claim 7, wherein the first side of the reservoir is deformable in response to an external pressure thereby establishing communication between the reservoir and the applicator portion.

9. An applicator according to claim 1, wherein the means to establish communication between the reservoir and the applicator portion includes an element capable of piercing the second side of the reservoir.

10. An applicator according to claim 9, wherein the element is a spike integral with the first side of the reservoir.

11. An applicator according to claim 9, wherein the first side of the reservoir is deformable in response to an external pressure thereby establishing communication between the reservoir and the applicator portion.

12. An applicator according to claim 1, wherein the first side of the reservoir is deformable in response to an external pressure thereby establishing communication between the reservoir and the applicator portion.

13. An applicator according to claim 1, wherein the applicator portion includes a porous material.

14. An applicator according to claim 1, wherein said applicator portion includes a fibrous material.

15. An applicator according to claim 1, wherein said applicator portion includes at least one material selected from the group consisting of: a thermoplastic foam material, a sponge material, a felt, and a material including natural fibers.

16. An applicator according to claim 1, wherein the applicator portion is made of a resiliently deformable material.

17. An applicator according to claim 1, wherein the applicator portion includes an application surface, and wherein the application surface includes a cover material, and wherein said cover material includes at least one material selected from the group consisting of: a flock material, a non-woven material, and a woven material.

18. An applicator according to claim 1, wherein the means to attach the applicator includes a hypoallergenic adhesive.

19. An applicator according to claim 1, wherein the applicator portion includes a cross-section through a thickness of the applicator portion having a convex shape at least on a side used to apply the product.

20. An applicator according to claim 19, wherein the applicator includes a cross-section through a thickness of the applicator having a concave shape on the first side of the reservoir.

21. An applicator according to claim 1, wherein the applicator includes a cross-section through a thickness of the applicator having a concave shape on the first side of the reservoir.

22. An applicator according to claim 1, wherein the applicator includes a cross-section through a thickness of the applicator having flattened shape with the first side of the reservoir substantially parallel to a face used to apply the product.

23. An applicator according to claim 1, wherein a front view of the applicator portion has a circular shape.

24. An applicator according to claim 1, wherein a frontal view of the applicator has a non-circular shape.

25. An applicator according to claim 24, wherein a frontal view of the applicator portion has a shape which is one of: triangular, square, oval, drop shaped, and almond shaped.

26. An applicator according to claim 1, wherein the means to attach includes an adhesive layer, and wherein the adhesive layer is covered before first use by a removable protective film.

27. An applicator according to claim 1, further including a product contained in the reservoir, and wherein the product is in liquid, semi-liquid or paste form.

28. An applicator according to claim 27, wherein applicator portion contains a second product intended to be mixed with the product held in the reservoir, and wherein the second product is in the form of a liquid, a semi-liquid, a paste, or a powder.

29. An applicator according to claim 1, further including a container including a closed recess containing at least one applicator.

30. An applicator according to claim 29, wherein the container is in the form of a sachet.

31. An applicator according to claim 29, wherein the container is in the form of a cell closed by a film.

32. An applicator according to claim 1, wherein said applicator includes at least one product selected from the group consisting of: a cosmetic, a dermatological product, a disinfectant product, a sunscreen, a moisturizing product, an anti-wrinkle product, a nail product, a foundation, a lip product, a makeup remover, a hair care product, a hair coloring product, a deodorant, an antiperspirant product, and a perfume.

33. An applicator according to claim 1, wherein the means to attach is adapted to attach the applicator to an end portion of a single finger.

34. An applicator according to claim 1, wherein the means to attach is adapted to attach the applicator to end portions of plural fingers.

35. An applicator according to claim 1, wherein the reservoir contains a liquid product component and said applicator portion includes another product component associated therewith, wherein when communication is established between said applicator portion and said reservoir said liquid product component wets said another product component.

36. An applicator according to claim 1, further including a container for containing at least one of said applicators, wherein said container includes a recess which receives an applicator and a cover which covers said recess, and further wherein said cover also covers the first side of said reservoir when said applicator is positioned inside of said container before use.

37. An applicator device for applying a product using at least one finger comprising:

a reservoir, said reservoir containing one of a product to be applied with said applicator device and a component of a product to be applied with said applicator device;

an applicator portion having a first surface configured to engage a portion of a body during use and a second surface secured to the second side of the reservoir located immediately adjacent the second surface of the applicator portion, said applicator portion including an applicator surface which is urged against a surface to which the product is to be applied for application of the product, wherein contents of said reservoir are isolated from said applicator portion at least prior to a first use of the applicator device;

an attachment arrangement for attaching the applicator device to at least one finger of a hand such that said applicator surface is at least partially disposed at an end portion of the at least one finger; and a breakable membrane separating the applicator portion from contents of the reservoir, the breakable membrane configured to establish communication between the reservoir and the applicator portion to supply contents of the reservoir to the applicator portion, wherein the applicator portion is permeable to the product, wherein the second surface of the applicator portion and the second side of the reservoir have respective areas and said second surface of the applicator portion and said second side of the reservoir are in contact with each other along substantially all their respective areas, and wherein the membrane forms the second side of the reservoir.

38. An applicator device according to claim 37, wherein said attachment arrangement is adapted to attach the applicator device to a single finger.

39. An applicator device according to claim 37, wherein said attachment arrangement is adapted to attach the applicator device to plural fingers.

40. An applicator device according to claim 37, wherein when mounted on the at least one finger, the reservoir is disposed between the at least one finger and the applicator portion.

41. An applicator device according to claim 37, wherein said attachment arrangement includes a loop adapted to encircle a portion of at least one finger.

42. An applicator device according to claim 37, wherein the attachment arrangement includes a hypoallergenic adhesive which is adapted to adhesively couple the applicator device to at least one finger.

43. An applicator device according to claim 37, wherein the attachment arrangement includes a finger stall configured to receive at least one finger.

44. An applicator device according to claim 37, wherein the attachment arrangement includes a hook and loop fastener and wherein a first component of the hook and loop fastener is adapted to mount on at least one finger and a second component of the hook and loop fastener is associated with said reservoir and said applicator portion.

45. An applicator device according to claim 37, wherein said reservoir contains a component of a product to be applied with said applicator device, and wherein after said means to establish communication establishes communication between said reservoir and said applicator portion said component mixes with another component contained in the applicator device.

46. An applicator device according to claim 45, wherein said another component is associated with said applicator portion before said means to establish communication establishes communication between said reservoir and said applicator portion.

47. An applicator device according to claim 46, wherein said component in said reservoir includes a liquid and wherein said another component includes vitamin C associated with said applicator portion.

48. An applicator device according to claim 47, wherein said component in said reservoir includes water.

49. An applicator device according to claim 37, wherein said applicator device includes at least one product selected from the group consisting of: a cosmetic, a dermatological product, a disinfectant product, a sunscreen, a moisturizing product, an anti-wrinkle product, a nail product, a foundation, a lip product, a make-up remover, a hair care product, a hair coloring, a deodorant, an antiperspirant, and a perfume.

50. An applicator device according to claim 37, wherein prior to establishing communication between said reservoir and the applicator said reservoir contains a product component including one of a liquid, a semi-liquid and a paste, and wherein prior to establishing communication between said reservoir and said applicator portion said applicator portion includes another product component including one of a liquid, a semi-liquid, a paste, and a powder.

51. An applicator device according to claim 37, wherein said breakable membrane is broken upon application of pressure to said applicator device.

52. An applicator device according to claim 37, further including a spike which pierces a wall of said reservoir.

53. An applicator device according to claim 37, further including a container having a plurality of cells with each cell containing at least one applicator device.

54. An applicator device according to claim 53, further including a plurality of film portions with each film portion individually closing a respective one of said plurality of cells.

55. An applicator device according to claim 54, wherein said attachment arrangement includes an adhesive on a first side thereof, and wherein when an applicator device is positioned in a cell of said container said first side faces upward and a film portion of said plurality of film portions extends over and covers the adhesive of said first side.

56. An applicator device according to claim 37, further including a sachet for containing at least one said applicator device.

57. An applicator device according to claim 37, wherein when mounted on said at least one finger said applicator device includes a first surface facing said at least one finger, and wherein said first surface has a concave shape.

58. An applicator device according to claim 57, wherein said applicator surface has a convex shape.

59. An applicator device according to claim 37, wherein said applicator surface includes a cover material.

60. An applicator device according to claim 59, wherein said cover material includes a flock material.

61. An applicator device according to claim 59, wherein said cover material includes a non-woven material.

62. An applicator device according to claim 59, wherein said cover material includes a woven material.

63. An applicator device according to claim 37, wherein the means to establish communication is a membrane that is breakable in response to an operating action at least during first use of the applicator, wherein after breaking, the product flows through the broken membrane so that it passes through the applicator portion to an application surface of the applicator.

64. An applicator device according to claim 37, wherein the applicator portion covers an opening in the membrane created by the breaking of the membrane.

65. An applicator device according to claim 37, wherein the applicator portion includes a second surface configured to be engaged with a surface of the reservoir, wherein the second surface of the applicator portion and the surface of the reservoir have substantially a same area.

66. An applicator for the application of a product, comprising:

a reservoir including a first side and a second side, wherein the second side is on an opposite side of the reservoir than the first side, and wherein the first side faces toward a finger when the applicator is mounted on a finger;

means to attach the applicator to a finger;

an applicator portion having a first surface configured to engage a portion of a body during use and a second surface secured to the second side of the reservoir located immediately adjacent the second surface of the applicator portion, the applicator portion being isolated from the reservoir at least before first use of the applicator; and means to establish communication between the reservoir and the applicator portion which includes a membrane breakable in response to an operating action at least during first use of the applicator, wherein the applicator portion is permeable to the product, wherein the second surface and the membrane have a respective areas, said second surface of the applicator portion and said membrane surface being in contact with each other on substantially all their areas, and wherein the membrane forms the second side of the reservoir.

67. An applicator for the application of a product, comprising:

a reservoir including a first side and a second side, wherein the second side is on an opposite side of the reservoir than the first side, and wherein the first side faces toward a finger when the applicator is mounted on a finger;

means to attach the applicator to a finger;

an applicator portion, the applicator portion being isolated from the reservoir at least before first use of the applicator; and a membrane configured to establish communication between the reservoir and the applicator portion and breakable in response to an operating action at least during first use of the applicator, wherein the applicator portion is permeable to the product, and wherein the means to attach the applicator includes an adhesive layer able to adhesively couple the applicator device to the finger, wherein a second surface of the applicator portion and the second side of the reservoir have respective areas, said second surface of the applicator portion and the second side of the reservoir are in contact with each other along substantially all their respective areas, and wherein the membrane forms the second side of the reservoir.

* * * * *